US005145533A

United States Patent [19]

Yoshitomi et al.

[11] Patent Number: 5,145,533

[45] Date of Patent: Sep. 8, 1992

[54] PROCESS FOR PRODUCING GRAIN-ORIENTED ELECTRICAL STEEL SHEET HAVING EXCELLENT MAGNETIC CHARACTERISTIC

[75] Inventors: Yasunari Yoshitomi; Yozo Suga; Nobuyuki Takahashi; Yoshiyuki Ushigami; Tadashi Nakayama, all of Kitakyushu, Japan

[73] Assignee: Nippon Steel Corporation, Tokyo, Japan

[21] Appl. No.: 769,586

[22] Filed: Oct. 2, 1991

Related U.S. Application Data

[63] Continuation of Ser. No. 502,420, Mar. 30, 1990, abandoned.

[30] Foreign Application Priority Data

Mar. 31, 1989 [JP] Japan ..... 1-82393

[51] Int. Cl.[5] ..... C21D 8/12

[52] U.S. Cl. ..... 148/111; 148/113; 73/104

[58] Field of Search ..... 148/111, 112, 113; 73/104, 599

[56] References Cited

U.S. PATENT DOCUMENTS

| | | | |
|---|---|---|---|
| 4,026,157 | 5/1977 | Goebbels | 73/599 |
| 4,539,848 | 9/1985 | Takafuji et al. | 73/599 |
| 4,994,120 | 2/1991 | Takahashi et al. | 148/111 |
| 5,049,205 | 9/1991 | Takahashi et al. | 148/112 |
| 5,066,343 | 11/1991 | Nakashima et al. | 148/112 |

FOREIGN PATENT DOCUMENTS

| | | |
|---|---|---|
| 59-56522 | 4/1984 | Japan . |
| 59-190325 | 10/1984 | Japan . |
| 60-197883 | 10/1985 | Japan . |
| 2130241 | 5/1984 | United Kingdom . |

OTHER PUBLICATIONS

*Metals Handbook,* 9th ed., vol. 9, pp. 129–130, 1985.

Patent Abstracts of Japan, vol. 12, No. 333 (C-526) [3180], Sep. 8, 1988, publication No. 63-93824.

Patent Abstracts of Japan, vol. 12, No. 11 (C-468) [2858], Jan. 13, 1988, publication No. 62-167821.

Patent Abstracts of Japan, vol. 10, No. 377 (C-392) [2434], Dec. 16, 1986, publication No. 61-170514.

Patent Abstracts of Japan, vol. 3, No. 68 (C-48) Jun. 13, 1979, publication No. 54-41220.

*Primary Examiner*—George Wyszomierski

*Attorney, Agent, or Firm*—Kenyon & Kenyon

[57] ABSTRACT

A process for producing a grain-oriented electrical steel sheet having an excellent magnetic characteristic, comprising the steps of: heating to a temperature lower than 1280° C. a steel slab comprising 0.025 to 0.075 wt % C, 2.5 to 4.5 wt % Si, 0.010 to 0.060 wt % acid-soluble Al, 0.0030 to 0.0130 wt % N, 0.014 wt % or less (S+0.405 Se), 0.05 to 0.8 wt % Mn, and the balance consisting of Fe and unavoidable impurities; hot-rolling the thus heated slab to form a hot-rolled strip; cold-rolling the hot-rolled strip to form a cold-rolled strip; decarburization-annealing the cold-rolled strip; applying an annealing separator on the strip; final-annealing the strip; measuring a primary-recrystallized grain size in the stage after completion of a primary recrystallization during the decarburization annealing and before completion of a secondary recrystallization during the final annealing; and controlling in that stage the subsequent grain growth of primary-recrystallized grains by an absorption of nitrogen into the steel strip in accordance with the measured grain size.

5 Claims, 1 Drawing Sheet

PROCESS FOR PRODUCING GRAIN-ORIENTED ELECTRICAL STEEL SHEET HAVING EXCELLENT MAGNETIC CHARACTERISTIC

This application is a continuation of application Ser. No. 07/502,420 filed Mar. 30, 1990, now abandoned.

BACKGROUND OF THE INVENTION

1. Field of the Invention

The present invention relates to a process for producing a grain-oriented electrical steel sheet having a high magnetic flux density and used for an iron core of transformers and the like.

2. Description of the Related Art

A grain-oriented electrical steel sheet is a soft magnetic material mainly used for an iron core material of transformers and other electrical equipment and must have good magnetic characteristics including magnetic exiting and watt-loss characteristics.

The exiting characteristic is usually represented by the value $B_8$, i.e., a flux density obtained when a magnetic field of 800 A/m is applied, and the watt-loss characteristic is usually represented by the value W17/50, i.e., a watt-loss value per 1 kg of a magnetic material when magnetized to 1.7 T under a frequency of 50 Hz.

The magnetic characteristics of a grain-oriented electrical steel sheet are obtained through the Goss-orientation having a {110} plane parallel to the sheet surface and a <001> axis in the rolling direction, which is established by a secondary recrystallization during a final annealing. To obtain a good magnetic characteristic, it is important that the axis <001>, i.e., an axis of easy magnetization, is precisely aligned in the rolling direction. The magnetic characteristic also depends significantly on the sheet thickness, the crystal grain size, the specific resistance, the surface coating, and the steel sheet purity, etc.

The grain orientation has been greatly improved by a process characterized in that MnS and AlN are utilized as inhibitors and that the final cold rolling is carried out at a severe reduction rate. This has also led to a remarkable improvement of the watt-loss characteristic.

Recent increases in energy costs have caused the transformer makers to adopt a material having a lower watt-loss for transformers. Although materials having a low watt-loss including an amorphous alloy and a 6.5%-Si steel sheet are being developed, there are many problems to be solved in utilizing such materials in industry. On the other hand, the magnetic-domain control using a laser, for example, was recently developed, and the watt-loss characteristic has been greatly improved thereby.

The flux density is the strongest factor dominating the watt-loss, and usually the higher the flux density, the better the watt-loss characteristic. A higher flux density is occasionally accompanied by a coarsening of the secondary-recrystallized grains, and resultant degradation of the watt-loss characteristic. The magnetic-domain control, however, ensures that the higher the flux density, the better the watt-loss characteristic, regardless of the secondary-recrystallized grain diameter. For this reason, the necessity for an enhancement of the flux density has recently increased.

The production of a grain-oriented electrical steel sheet is usually carried out under extremely severe management criteria for each process step, because various factors in each step affect the magnetic characteristics. Such a way of production, however, consumes a great deal of time for management, and moreover, suffers from more than a few ill-defined degradations of the magnetic characteristics. If the magnetic characteristic of a product sheet could be predicted at an intermediate process step the above-mentioned problems of the production could be solved, but such a prediction has not yet been practically achieved despite various attempts A currently produced grain-oriented electrical steel sheet usually utilizes MnS as an inhibitor, in which MnS is once dissolved during a slab heating for hot rolling and later allowed to precipitate during hot rolling. To dissolve MnS in an amount effective for the secondary recrystallization, a slab must be heated at a temperature of around 1400° C., which is more than 200° C. higher than the slab heating temperature for common steels, and has the following disadvantages.

(1) A slab heating furnace is required exclusively for the grain-oriented electrical steel sheet.

(2) The unit energy consumption of a heating furnace is high.

(3) The amount of molten scale is increased and the process operation is adversely affected; the scale must be scraped off.

Many attempts have been made to enable a heating of a slab at a lower temperature, but various problems still remain.

The present inventors and others have already disclosed a process in which a low temperature slab heating is enabled by defining the Mn content of from 0.08 to 0.45 wt % and the S content of 0.007 wt % or less (Japanese Unexamined Patent Publication (Kokai) No. 59-56522). The basic principle of this process is that the S content is reduced to ensure a [Mn] [S] product value not exceeding that obtained at 1200° C. and that the secondary recrystallization is assistively stabilized by the addition of P and the heating rate of 15° C./hour or slower during final annealing, etc. This process has made further progress in that the secondary recrystallization is stabilized and the magnetic characteristic is improved by the addition of Cr, as disclosed in Japanese Unexamined Patent Publication (Kokai) No. 59-190325.

SUMMARY OF THE INVENTION

The object of the present invention is to provide a process for stably producing a grain-oriented electrical steel sheet having an excellent magnetic characteristic by predicting the magnetic characteristic of product sheet at an intermediate process step.

To achieve the object according to the present invention, there is provided a process for producing a grain-oriented electrical steel sheet having an excellent magnetic characteristic, comprising the steps of:

heating to a temperature lower than 1280° C. a steel slab comprising 0.025 to 0.075 wt % C, 2.5 to 4.5 wt % Si, 0.010 to 0.060 wt % acid-soluble Al, 0.0030 to 0.0130 wt % N, 0.014 wt % or less (S+0.405 Se), 0.05 to 0.8 wt % Mn, and the balance consisting of Fe and unavoidable impurities;

hot-rolling the thus heated slab to form a hot-rolled strip;

cold-rolling the hot-rolled strip to form a cold rolled strip;

decarburization-annealing the cold-rolled strip;

applying an annealing separator on the strip;

final-annealing the strip;

measuring a primary-recrystallized grain size in the stage after completion of a primary recrystallization during said decarburization annealing and before completion of a secondary recrystallization during said final annealing; and controlling in said stage the subsequent grain growth of primary-recrystallized grains by an absorption of nitrogen into the steel strip.

DESCRIPTION OF THE PREFERRED EMBODIMENTS

Figure 1:
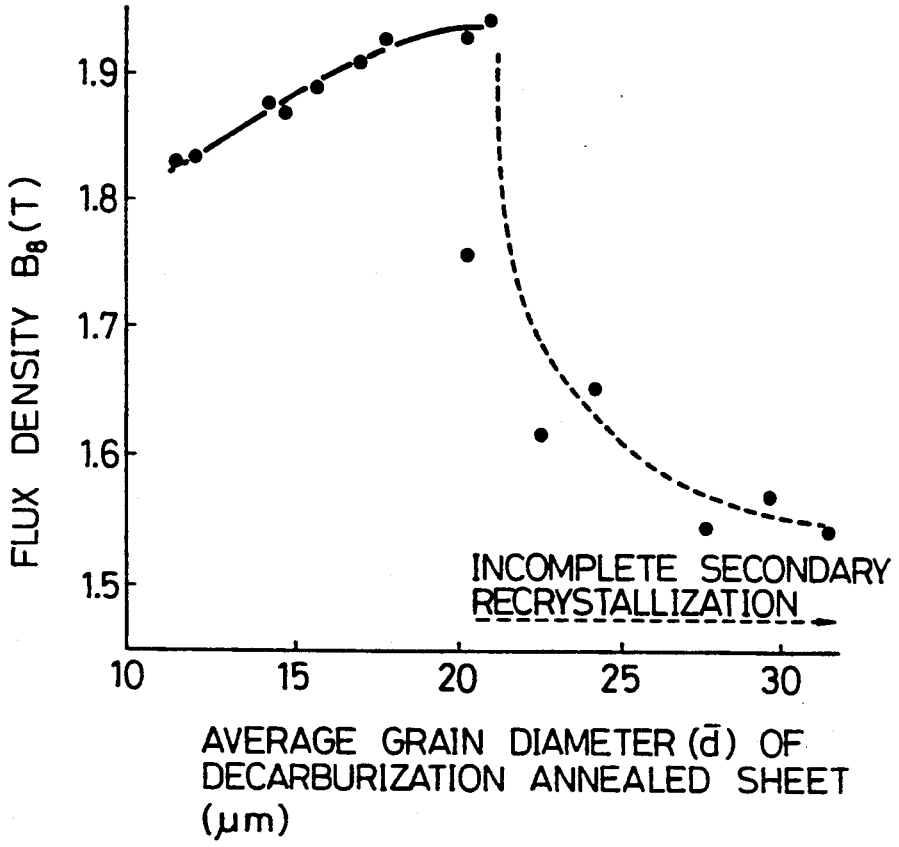
FIG. 1 shows the relationship between the average grain diameter of decarburization-annealed sheets and the magnetic flux density of product sheets.

In a grain-oriented electrical steel sheet to which the present invention is applied, a molten steel prepared by a conventional steelmaking process is cast by a continuous casting method or a ingot casting method, the thus obtained casting is subjected to a blooming step in accordance with the need to form a slab, which is then hot-rolled, subjected to a necessary hot-strip annealing, cold-rolled to form a cold-rolled sheet having a final gauge by a single step of cold rolling or by two or more steps of cold rolling with an intermediate annealing inserted therebetween, and the cold-rolled sheet is then decarburization-annealed. After studying the decarburization annealing step, the present inventors studied, from various points of view, the relationship between the property of the decarburized steel sheet and the magnetic characteristics of the product steel sheet, and obtained an astonishing novel finding as described below in detail, based on experimental results.

FIG. 1 shows the relationship between the average grain diameter ($\bar{d}$) of the decarburized steel sheet and the magnetic flux density ($B_8$) of the product steel sheet. The diameter "d" was obtained by image-analysis of the image input from an optical microscope and converted as a circle diameter, i.e., the diameter of a circle which has the same area as that of a grain. In this case, the product sheets were obtained by heating to 1150° C. a steel slab containing 0.056 wt % C, 3.24 wt % Si, 0.025 wt % acid-soluble Al, 0.0079 wt % N, 0.006 wt % S, 0.15 wt % Mn, hot-rolling the thus heated slab in a known manner to form 2.3 mm thick hot-rolled strips, annealing the hot-rolled strips at different temperatures of 900° to 1200° C., cold-rolling the annealed strips at a final cold rolling reduction of about 88% to form 0.285 mm thick cold-rolled strips, decarburization-annealing the cold-rolled strips at different temperatures of 830° to 1000° C., applying to the strips an annealing separator containing MgO as the major component, and final-annealing the strips.

It is seen from FIG. 1 that a strong correlation is present between the average grain diameter of decarburized sheet and the flux density of product sheet, and therefore, the latter can be predicted from the former.

Utilizing this correlation, the present inventors have found that the flux density is enhanced if the process condition after the decarburization annealing and before the completion of the secondary recrystallization during final annealing is controlled, when the measured average grain diameter of decarburized sheet is smaller than an appropriate value, so that the grain growth of primary-recrystallized grains is facilitated, or when the measured average grain diameter is larger than the appropriate value, so that the grain growth of primary-recrystallized grains is difficult.

The present inventors also carried out various studies on the control of the grain growth of primary-recrystallized grains, and found that it is extremely effective to induce a steel sheet to absorb nitrogen and to form a nitride in the steel sheet.

The present invention is based on the phenomenon that the flux density of product sheet can be predicted from the average grain diameter of decarburized sheet. Although the mechanism is not fully explained, the present inventors consider it to be as follows.

Factors influencing the secondary recrystallization phenomenon are considered to include the primary-recrystallized microstructure, the primary-recrystallized texture, and inhibitors and many studies thereon have been made. A deeper consideration of the relationship between microstructure and texture leads to an assumption that the average grain diameter is indirectly descriptive of the texture, assuming the grain growth causes a change of the texture, or that the average grain diameter is indirectly descriptive of the grain diameter distribution when it is assumed that the grain growth causes a change in the grain distribution. The average grain diameter is a quantity substantially inversely proportional to the total grain boundary area per unit area, and therefore, significantly affects the driving force for the grain growth of secondary-recrystallized grains. Thus, the average grain diameter is considered to be a parameter simultaneously descriptive of three factors of the texture, the grain diameter distribution, and the total grain boundary area, which has a great influence on the secondary recrystallization phenomenon.

From this consideration, the mechanism by which the flux density of product sheet can be predicted based on the average grain diameter is assumed to be that the average grain diameter is simultaneously descriptive of the three factors of the texture, the grain diameter distribution, and the total grain boundary area, which all are considered to have a great influence on the secondary recrystallization phenomenon, and therefore, the average grain diameter has an extremely strong correlation with the flux density, which represents the oriented condition of secondary-recrystallized grains.

This is assumed to be the reason why the flux density is enhanced if the process condition after the decarburization annealing and before the completion of the secondary recrystallization during final annealing is controlled, when the measured average grain diameter of a decarburized sheet is smaller than an appropriate value, so that the grain growth of primary-recrystallized grains is facilitated, or when the measured average grain diameter is larger than the appropriate value, so that the grain growth of primary-recrystallized grains is difficult or an incomplete secondary recrystallization rarely occurs.

When a measured average grain diameter of decarburized sheet is equal to an appropriate value, it is assumed that a product sheet having a high flux density can be obtained without considering a particular nitriding treatment control.

The reasons for the specified limitations of the present invention are as follows.

The composition and the heating temperature of a steel slab are limited for the following reasons.

The C content must not be less than 0.025 wt %, because a C content of less than 0.025 wt % causes an unstable secondary recrystallization, or even if the secondary recrystallization is completed, a high $B_8$ value greater than 1.80 T is difficult to obtain. On the other hand, the C content must not exceed 0.075 wt %, because an excessive C content requires an extended annealing time, which is not economical.

The Si content must not exceed 4.5 wt %, because a Si content of more than this amount causes heavy cracking during cold-rolling. The Si content must be 2.5 wt % or more, on the other hand, because a Si content of less than 2.5 wt % causes the specific resistance of steel sheet to become too low to exhibit a watt-loss value necessary for a material for transformer cores. The Si content is preferably 3.2 wt % or more.

Aluminum and nitrogen are necessary to ensure the formation of AlN and/or (Si, Al)N sufficient for stabilizing the secondary recrystallization. In this respect, aluminum must be present in an amount of 0.010 wt % or more in terms of the amount of acid-soluble Al. The Al content must not exceed 0.060 wt % because an inappropriate AlN is formed in a hot-rolled strip and the secondary recrystallization becomes unstable when the Al content is more than 0.060 wt %. The nitrogen content of less than 0.0030 wt % is difficult to obtain through a usual steelmaking process, and is not preferred from the economical point of view. When the N content exceeds 0.0130 wt %, a "blister" or a swelling occurs on the steel sheet surface. The specified N content of from 0.0030 to 0.0130 wt % is sufficient to form the necessary AlN and/or (Si, Al)N without causing the above-mentioned problems.

A good magnetic characteristic can be obtained even when MnS and/or MnSe are present in a steel sheet, by selecting suitable process conditions. Nevertheless, when S or Se is present in a high amount, an incompletely secondary-recrystallized portion, referred to as a linear fine grain, tends to occur. To prevent the formation of such an incomplete secondary-recrystallized portion, the sum of the S and Se contents must fall within the range defined by the expression $(S+0.405Se) \leqq 0.014$ wt %. If the S or Se content does not satisfy this limitation, the incompletely secondary-recrystallized portion occurs at a high probability no matter how the process conditions are adjusted. Such an inappropriate S or Se content is also undesirable because an extremely long time is required for effecting purification during final annealing. From these points of view, the S and the Se contents should be reasonably lower.

The specified lower limit for the Mn content is 0.05 wt %. A Mn content less than the lower limit degrades the side edge shape of a hot-rolled strip, to cause a reduced yield. The Mn content, however, is preferably equal to or more than the amount defined by the expression $\{0.05+7(S+0.405Se)\}$ wt %, to form a good forsterite coating on a steel sheet. This is because MnO acts as a catalyst in the $MgO/SiO_2$ solid phase reaction, i.e., a reaction to form a forsterite coating, as fully discussed by the present inventors and others in Japanese Patent Application No. 59-53819. To ensure a Mn activity in steel on a level necessary for the reaction, Mn is preferably present in an amount sufficient to trap S or Se to form MnS or MnSe, i.e., in an amount equal to or more than $\{0.05+7(S+0.405\ Se)\}$ wt %. When the Mn content is less than this amount, the forsterite coating has a coarse crystal grain size and the adhesivity of the coating is also relatively reduced. In most cases, however, a secondary coating containing colloidal silica as a main component is additionally applied on the forsterite coating to provide a product sheet, and therefore, such a coarse grain size or reduced adhesivity of a forsterite coating does not practically cause problems.

The Mn content is desirably equal to or more than the above formulated value, to prevent an inferior coating or an unstable secondary recrystallization.

The Mn content must be 0.8 wt % or less because a Mn content of more than this amount causes a reduction of magnetic flux density.

The slab heating temperature is limited to below 1280° C., i.e., as low as that for common steels, to enable the production cost to be reduced. Namely, the slab heating temperature is preferably not higher than 1150° C.

As in the known manner, the thus-heated steel slab is hot-rolled, annealed in accordance with need, and then cold-rolled by a single step of cold rolling or by two more steps of cold rolling with intermediate annealing inserted therebetween to form a cold-rolled strip having a final gauge. The cold-rolled strip is then subjected to decarburization annealing, application of an annealing separator containing MgO as the major component, and final annealing. The most important feature of the present invention is to predict and control the magnetic characteristic of product sheet at the stage of from the decarburization annealing to the final annealing. The reason for the specified limitations to this sequence is described below.

The present invention features the steps of: measuring a primary-recrystallized grain size after the completion of primary recrystallization during decarburization annealing and before the completion of secondary recrystallization during final annealing; and controlling the subsequent grain growth of primary-recrystallized grains by absorption of nitrogen into the steel strip in accordance with the measured grain size.

This limitation is based on the phenomenon that a strong correlation is present between the average grain size of decarburized sheet and the flux density of product sheet and that the flux density is enhanced if the process condition after the measurement of the primary-recrystallized grain size and before the completion of the secondary recrystallization during final annealing is controlled in terms of the nitriding condition, when the measured grain size of the primary-recrystallized grains is smaller than an appropriate value, so that the grain growth of primary-recrystallized grains is facilitated or when the measured grain size of the primary-recrystallized grains is larger than the appropriate value, so that the grain growth of primary-recrystallized grains is difficult.

The measuring and the controlling are carried out in the process stage between the completion of primary recrystallization during decarburization annealing and the completion of secondary recrystallization during final annealing, because the present invention intends to measure the degree of growth of primary-recrystallized grains and to control the subsequent nitriding condition in such a way that an appropriate grain growth proceeds. Measuring of the grain growth degree before the completion of primary recrystallization or after the completion of secondary recrystallization is impossible or useless.

The measuring is specified to be carried out for the primary-recrystallized grain size because, if even one grain is measured without directly measuring the average grain size, the average grain size and the grain size distribution can be statistically estimated, and therefore, all measurable parameters having a relationship with the grain size are included in the principle of the present invention in which the degree of the growth of primary-recrystallized grains is measured and the subsequent grain growth is controlled to stably obtain a high flux density of product sheet. Thus, the term "measuring the grain size of primary-recrystallized grains" according to the present invention should be understood to have a wider meaning of "measuring a parameter having a relationship with the grain size".

The method of measuring the grain size is not specifically limited and may be a method using an ultrasonic or a magnetic detector provided in a decarburization annealing line to measure a grain size-related parameter, a method in which grain boundaries of a sample from a decarburized sheet are detected by an optical or an electron microscope and analyzed by an intersecting procedure or an image analysis to determine a grain size-related parameter, or a method in which a grain size-related parameter is measured during final annealing by using an ultrasonic or a magnetic means.

The method of controlling the grain growth of primary-recrystallization by absorption of nitrogen into steel after the measuring is not specifically limited and may be a method in which the grain size is measured during decarburization annealing and the temperature, the time, the partial nitrogen pressure, etc. are adjusted for the rest of the decarburization annealing period, a method in which the grain diameter is measured after the decarburization annealing and a nitriding step using $NH_3$ gas, plasma etc. for adjusting the grain size is additionally carried out, a method in which the heat history and the partial nitrogen pressure of atmospheric gas is adjusted in the final annealing step, a method in which the grain size is measured during or after the decarburization annealing and the amount and/or quality of a nitride to be added to an annealing separator are adjusted, or a method in which the partial oxygen pressure during decarburization annealing and the additive to an annealing separator, which both affect the formation of a coating, are adjusted to control the absorption of nitrogen into steel during the final annealing.

The absorption of nitrogen into steel is extremely effective for controlling the grain growth, because it causes a formation of AlN, (Al, Si)N and other nitrides, to thereby suppress the grain growth of primary-recrystallized grains.

EXAMPLES

Example 1

A steel slab containing 0.056 wt % C, 3.24 wt % Si, 0.15% Mn, 0.006 wt % S, 0.025 wt % acid-soluble Al, 0.0079 wt % N was heated to 1150° C. and hot-rolled to form a 2.3 mm thick hot-rolled strip. The strip was annealed at 1150° C., cold-rolled to a final thickness of 0.285 mm and then decarburization-annealed 850° C. An image analysis of the decarburized sheet showed an average grain diameter of 15 μm. It was predicted from this result that a flux density ($B_8$) of 1.90 T or lower would be obtained if an annealing separator containing MgO as the major component were applied on the sheet followed by a final annealing, and thus an adjustment was carried out for the final annealing condition as follows.

The strip was heated to 1200° C. at a heating rate of 10° C./hr in an atmosphere of 10% $N_2$ plus 90% $H_2$ or having a relatively lowered partial nitrogen pressure and held there for 20 hours in a changed atmosphere of 100% $H_2$ to complete final annealing.

For comparison, a sample from the same strip was heated to 1200° C. at a heating rate of 10° C./hr in an atmosphere of 25% $N_2$ plus 75% $H_2$ and held there for 20 hours in an atmosphere of 100% $H_2$ to complete final annealing.

The flux density data for these final-annealed sheet products are shown in Table 1.

TABLE 1

| Final annealing condition | $B_8$ (T) |
|---|---|
| Invention | 1.93 |
| Comparison | 1.89 |

Example 2

The hot-rolled strip of Example 1 was heated at 1150° C. for 30 sec, slowly cooled to 900° C., then rapidly cooled to the room temperature, subsequently cold-rolled to a final thickness of 0.285 mm, and decarburization-annealed at 875° C. An analysis of the decarburized sheet showed a grain diameter of 22 μm.

It was predicted from this result that an incomplete secondary-recrystallized portion would occur if an annealing separator containing MgO as the major component were applied on the sheet followed by a final annealing, and thus an adjustment was carried out for the annealing separator as follows.

An annealing separator containing MgO as the major component and mixed with 10% of MnN was applied on the sheet. It is known that MnN is decomposed during final annealing to induce nitrogen absorption into steel.

For comparison, an annealing separator containing MgO as the major component but not mixed with MnN was applied on the sheet.

The sheets were final-annealed under the same condition as that for the comparative sample of Example 1.

The results for these final-annealed product sheets are shown in Table 2.

TABLE 2

| Process condition | Percentage of secondary re-crystallization | $B_8$ (T) |
|---|---|---|
| Invention | 100 | 1.92 |
| Comparison | 65 | 1.75 |

Example 3

A steel slab containing 0.054 wt % C, 3.22 wt % Si, 0.13 wt % Mn, 0.007 wt % S, 0.029 wt % acid-soluble Al, 0.0078 wt % N was heated to 1150° C. and hot-rolled to form a 2.3 mm thick hot-rolled strip. The strip was heated at 1150° C. for 30 sec, slowly cooled to 900° C., rapidly cooled to room temperature, subsequently cold-rolled to form a cold-rolled sheet having a final thickness of 0.285 mm. The sheet was heated at 830° C. for 150 sec and then heated at 900° C. to effect decarburization annealing. An image analysis of the decarburized sheet showed a grain diameter of 26 μm.

It was predicted from this result that an incomplete secondary-recrystallized portion would occur if an annealing separator containing MgO as the major component were applied on the sheet followed by a final annealing, and thus an adjustment was carried out for the steel sheet surface as follows.

To establish a surface coating condition which facilitates the nitrogen absorption during final annealing, an oxidized coating on the decarburized sheet was removed with an acid.

For comparison, a sample from the same sheet having an oxidized coating thereon was used.

An annealing separator containing MgO as the major component was applied on these sheets, which were then final-annealed under the same condition as that for the comparative sample of Example 1.

The results for these final-annealed product sheets are shown in Table 3.

TABLE 3

| Process condition | Percentage of secondary recrystallization | $B_8$ (T) |
|---|---|---|
| Invention | 100 | 1.93 |
| Comparison | 63 | 1.66 |

Example 4

For the decarburized sheet of Example 3, an adjustment was carried out for final annealing as follows.

The decarburized sheet was heated to 800° C. at a heating rate of 10° C./hr in an atmosphere of 25% $N_2$ plus 75% $H_2$, heated from 800° C. to 1200° C. at a heating rate of 10° C./hr in an atmosphere of 75% $N_2$ plus 25% $H_2$ or having a raised partial nitrogen pressure, and held at 1200° C. for 20 hours in an atmosphere of 100% $H_2$ to complete final annealing.

For comparison, the decarburized sheet was final-annealed under the same condition as that for the comparative sample of Example 1.

The results for these final-annealed product sheets are shown in Table 4.

TABLE 4

| Process condition | Percentage of secondary recrystallization | $B_8$ (T) |
|---|---|---|
| Invention | 100 | 1.93 |
| Comparison | 63 | 1.66 |

Example 5

The cold-rolled sheet of Example 3 was heated at 830° C. for 150 sec and subsequently heated at 900° C. for 20 sec to complete decarburization annealing, during which the average grain diameter was measured by an on-line ultrasonic detector when the sheet was held at 900° C. for 10 sec. The measurement showed a grain diameter of 25 μm.

It was predicted from this result that an incomplete secondary-recrystallized portion would occur if an annealing separator containing MgO as the major component were applied on the sheet followed by a final annealing, and thus an adjustment was carried out for the annealing separator as follows.

An annealing separator containing MgO as the major component and mixed with 10% of MnN was applied on the sheet. It is known that MnN is decomposed during final annealing to induce nitrogen absorption into steel.

For comparison, an annealing separator containing MgO as the major component but not mixed with MnN was applied on the sheet.

The sheets were final-annealed under the same condition as that for the comparative sample of Example 1.

The results for these final-annealed product sheets are shown in Table 5.

TABLE 5

| Process condition | Percentage of secondary recrystallization | $B_8$ (T) |
|---|---|---|
| Invention | 100 | 1.94 |
| Comparison | 63 | 1.66 |

As described above, the present invention has a great advantage in a process for producing a grain-oriented electrical steel sheet, in the following two points.

The present invention enables a stable production of a product sheet having an excellent magnetic characteristic by a combined prediction and control of the magnetic characteristic of product sheet, in which the grain size of primary-recrystallized grains is measured in the stage after the completion of primary recrystallization during decarburization annealing and before the completion of secondary recrystallization during final annealing.

The present invention also enables a sharp reduction of the production cost, because the heating of steel slab to be hot-rolled may be carried out at a temperature comparable with that for common steels, and therefore, a slab heating furnace exclusively for a grain-oriented electrical steel sheet is not required, and further, the energy consumption and scale formation is reduced.

We claim:

1. A process for producing a grain-oriented electrical steel sheet having an excellent magnetic characteristic, comprising the steps of:

heating to a temperature lower than 1280° C. a steel slab comprising 0.025 to 0.075 wt % C, 2.5 to 4.5 wt % Si, 0.010 to 0.060 wt % acid-soluble Al, 0.0030 to 0.0130 wt % N, 0.014 wt % or less (S+0.405 Se), 0.05 to 0.8 wt % Mn, and the balance consisting of Fe and unavoidable impurities;

hot-rolling the thus heated slab to form a hot-rolled strip;

cold-rolling the hot-rolled strip to form a cold-rolled strip having a thickness of a final product sheet;

decarburization-annealing the cold-rolled strip;

applying an annealing separator on the strip;

final-annealing the strip;

measuring a primary-recrystallized grain size in the stage after completion of primary recrystallization during said decarburization annealing and before completion of secondary recrystallization during said final annealing;

controlling in said stage subsequent grain growth of primary-recrystallized grains by increasing nitrogen absorption into said steel strip thereby increasing nitrides in said steel strip to suppress primary recrystallized grain growth when said measured primary recrystallized grain size is greater than a first value, and by decreasing nitrogen absorption in said steel strip thereby decreasing formation of nitrides caused by nitrogen absorption in said steel strip to enhance primary recrystallized grain growth when the measured primary recrystallized grain size is smaller than a second value;

said first value being a minimum primary-recrystallized grain size above which an incomplete secondary recrystallization occurs, and being determined from a relationship between the primary-recrystallized grain size and the magnetic flux density of a final product sheet;

said second value being a primary-recrystallized grain size at which a complete secondary recrystallization is achieved and the magnetic flux density of a final product sheet has a $B_8$ value of about 1.88 Tesla;

said increasing and decreasing of nitrogen absorption into said steel strip for controlling a subsequent growth of primary recrystallized grains being affected by at least one of the following operations (1) to (8);

(1) measuring a primary-recrystallized grain size in the decarburization annealing step and increasing or decreasing a nitrogen partial pressure in an atmosphere used for the rest of said decarburization annealing period;

(2) measuring a primary-recrystallization grain size after completion of said decarburization annealing and then nitriding said steel sheet in an atmosphere containing ammonia gas while controlling the ammonia gas concentration thereof;

(3) measuring a primary-recrystallization grain size after completion of said decarburization annealing and then nitriding said steel sheet by a plasma, controlling the plasma concentration;

(4) increasing or decreasing a nitrogen partial pressure of an atmosphere used for said final annealing;

(5) nitriding said steel strip by controlling a staying time of the strip in a temperature region in said final annealing step, in which temperature region nitrogen absorption into said steel strip easily occurs;

(6) nitriding said steel strip in said final annealing step by controlling the nitride content of said annealing separator which is mainly composed of MgO;

(7) controlling a nitriding of said steel strip by controlling an oxygen partial pressure in said decarburization annealing step; and (8) controlling a nitriding of said steel strip by controlling an amount of an oxidized layer removed from the surface of said steel strip by pickling after completion of said decarburization annealing.

2. A process according to claim 1, wherein said measurement of a primary-recrystallization grain size is carried out by an on-line ultrasonic detector during said decarburization annealing.

3. A process according to claim 1, wherein said measurement of a primary-recrystallized grain size is carried out by an image analysis of a decarburization-annealed strip.

4. A process according to claim 1, wherein said control of the subsequent grain growth of primary-recrystallized grains by absorption of nitrogen into the steel strip is carried out by said operator number (4) or (5).

5. A process according to claim 1, wherein said control of the subsequent grain growth of primary-recrystallized grains by absorption of nitrogen into the steel strip is carried out by said operation number (6).

* * * * *